US008261374B2

(12) United States Patent
Petzl et al.

(10) Patent No.: US 8,261,374 B2
(45) **Date of Patent: *Sep. 11, 2012**

(54) PROTECTION HELMET WITH IMPROVED ADJUSTABLE NECKBAND

(75) Inventors: Paul Petzl, Barraux (FR); Raphaël Lanez, Crolles (FR); Emmanuel D'Adhemar, Domène (FR)

(73) Assignee: Zedel, Crolles (FR)

( * ) Notice: Subject to any disclaimer, the term of this patent is extended or adjusted under 35 U.S.C. 154(b) by 132 days.

This patent is subject to a terminal disclaimer.

(21) Appl. No.: 12/457,384

(22) Filed: Jun. 9, 2009

(65) Prior Publication Data

US 2009/0320186 A1 Dec. 31, 2009

(30) Foreign Application Priority Data

Jun. 26, 2008 (FR) ..... 08 03613

(51) Int. Cl.
*A42B 1/22* (2006.01)

(52) U.S. Cl. ..... 2/418; 2/417; 2/410

(58) Field of Classification Search ..... 2/410, 417, 2/209.7, 418, 419, 420, 421
See application file for complete search history.

(56) References Cited

U.S. PATENT DOCUMENTS

| | | | | |
|---|---|---|---|---|
| 3,748,657 | A * | 7/1973 | Aileo | 2/6.4 |
| 4,051,555 | A | 10/1977 | Daly | |
| RE34,699 | E * | 8/1994 | Copeland et al. | 2/419 |
| 5,373,588 | A | 12/1994 | Hede et al. | |
| 2006/0168712 | A1 | 8/2006 | Mazzoccoli et al. | |

FOREIGN PATENT DOCUMENTS

| | | | |
|---|---|---|---|
| DE | 10 2006 034 710 | A1 | 1/2008 |
| EP | 0 558 427 | A1 | 9/1993 |
| EP | 1 656 045 | A1 | 5/2006 |
| WO | WO 2005/016047 | A1 | 2/2005 |
| WO | WO 2008/011936 | A1 | 1/2008 |

* cited by examiner

*Primary Examiner* — Khoa Huynh
*Assistant Examiner* — Andrew W Collins
(74) *Attorney, Agent, or Firm* — Oliff & Berridge, PLC

(57) ABSTRACT

A protective helmet is composed of an external crown made from plastic material, and a semi-rigid neckband adjustable by adjustment means. At least one end of the neckband is joined to the crown by a sliding mechanical link comprising position indexing means controlled from a slide able to be moved from the outside in a slit of the crown. The indexing means are formed by a rack molded directly along with the crown.

6 Claims, 7 Drawing Sheets

PROTECTION HELMET WITH IMPROVED ADJUSTABLE NECKBAND

BACKGROUND OF THE INVENTION

The invention relates to a protective helmet composed of a crown made from plastic material, and a semi-rigid neckband adjustable by adjustment means.

STATE OF THE ART

The ELIOS helmet marketed under the PETZL trademark by the applicant relates to a helmet having a crown made from shock-resistant injected polycarbonate, an internal shell made from expanded polypropylene foam, a chin strap, and a headband. Adjustment of the latter is performed by means of a single adjustment point located at the rear of the helmet at the level of the neck. The adjustment device comprises racks arranged at the two straight rear ends of the headband and operating in conjunction with a rotary operating part which is placed in the middle zone.

The ECRIN helmet marketed under the PETZL trademark by the applicant and described in the document EP 558427 relates to a helmet composed of an external crown made of polycarbonate and an assembly formed by the headband and neckband totally housed inside the crown. Adjustment of the helmet is performed by means of two internal adjustment knobs which engage with notches of racks provided in the headband and neckband. The knobs are partially salient under the side edge on each side of the crown. One of the knobs is used for adjusting the headband and the other for adjusting the neckband.

In the above-mentioned two known helmets, the peripheral length of the neckband is made to vary during adjustment on account of the fact that the racks are located directly on the neckband.

OBJECT OF THE INVENTION

The object of the invention consists in providing a protective helmet equipped with a neckband with quick and practical adjustment.

The device according to the invention is characterized in that at least one end of the neckband is joined to the crown by a sliding mechanical link comprising position indexing means controlled from a slide able to be moved from the outside in a slit of the crown.

The indexing means are securedly attached to the inside wall of the crown and can be molded directly along with the crown.

The length of the neckband remains constant during adjustment, whereas its attachment point is made to vary by means of the indexing means located on the inside wall of the crown. Adjustment is thereby made easier.

According to a preferred embodiment, the indexing means are formed by a rack comprising two series of notches separated by a slit housing the slide. The slide is equipped with an unlocking button provided with a coupling part bearing pins cooperating by clipping with the rack by the action of a return spring. The slide supports two legs for guiding the unlocking button when the latter is moved between the active and inactive positions.

The slit for movement of the slide can be straight or curved and the neckband can be of any shape.

BRIEF DESCRIPTION OF THE DRAWINGS

Other advantages and features will become more clearly apparent from the following description of particular embodiments of the invention given for non-restrictive example purposes only and represented in the appended drawings in which.

DESCRIPTION OF A PREFERRED EMBODIMENT OF THE INVENTION

Figure 1:
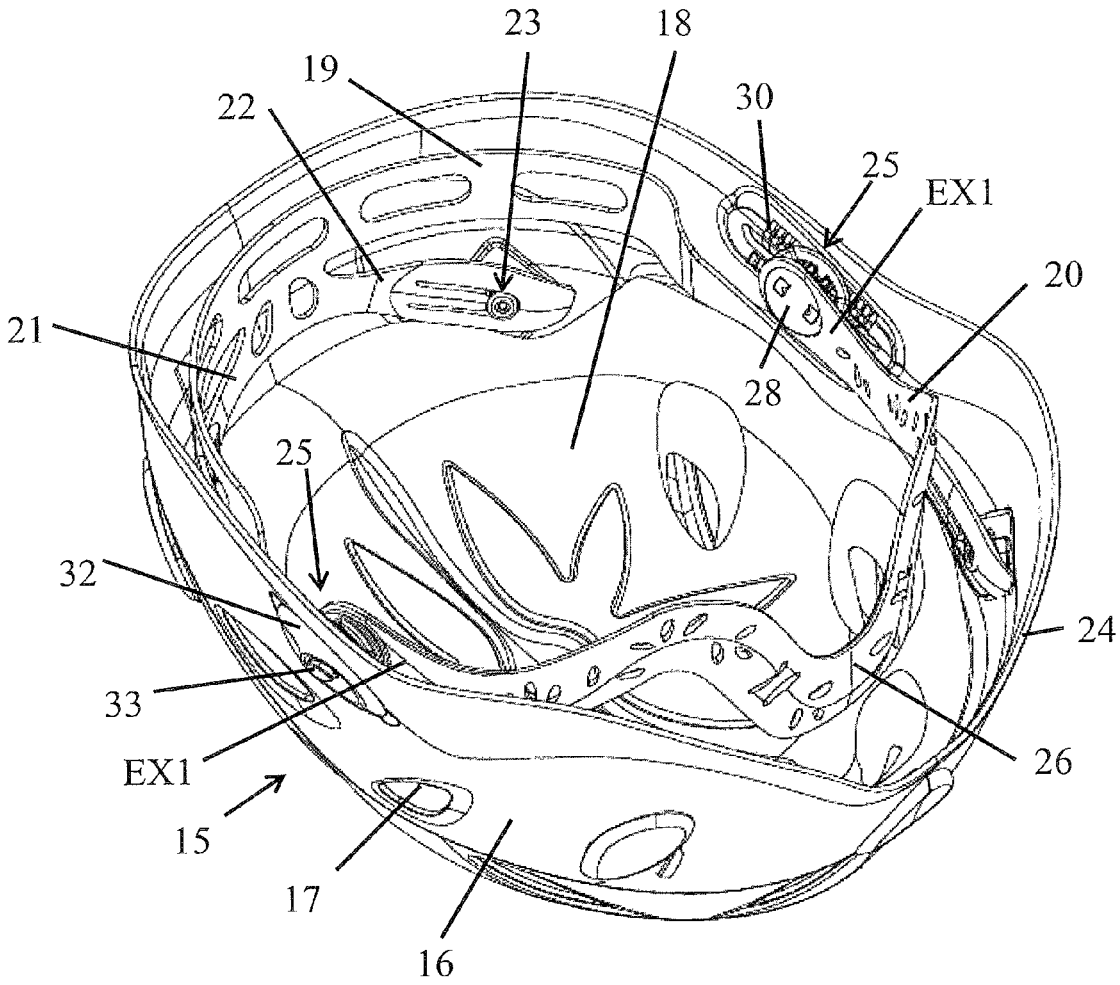
FIG. 1 represents a perspective view of the inside of the helmet with the neckband adjustment device according to the invention.
Figure 2:
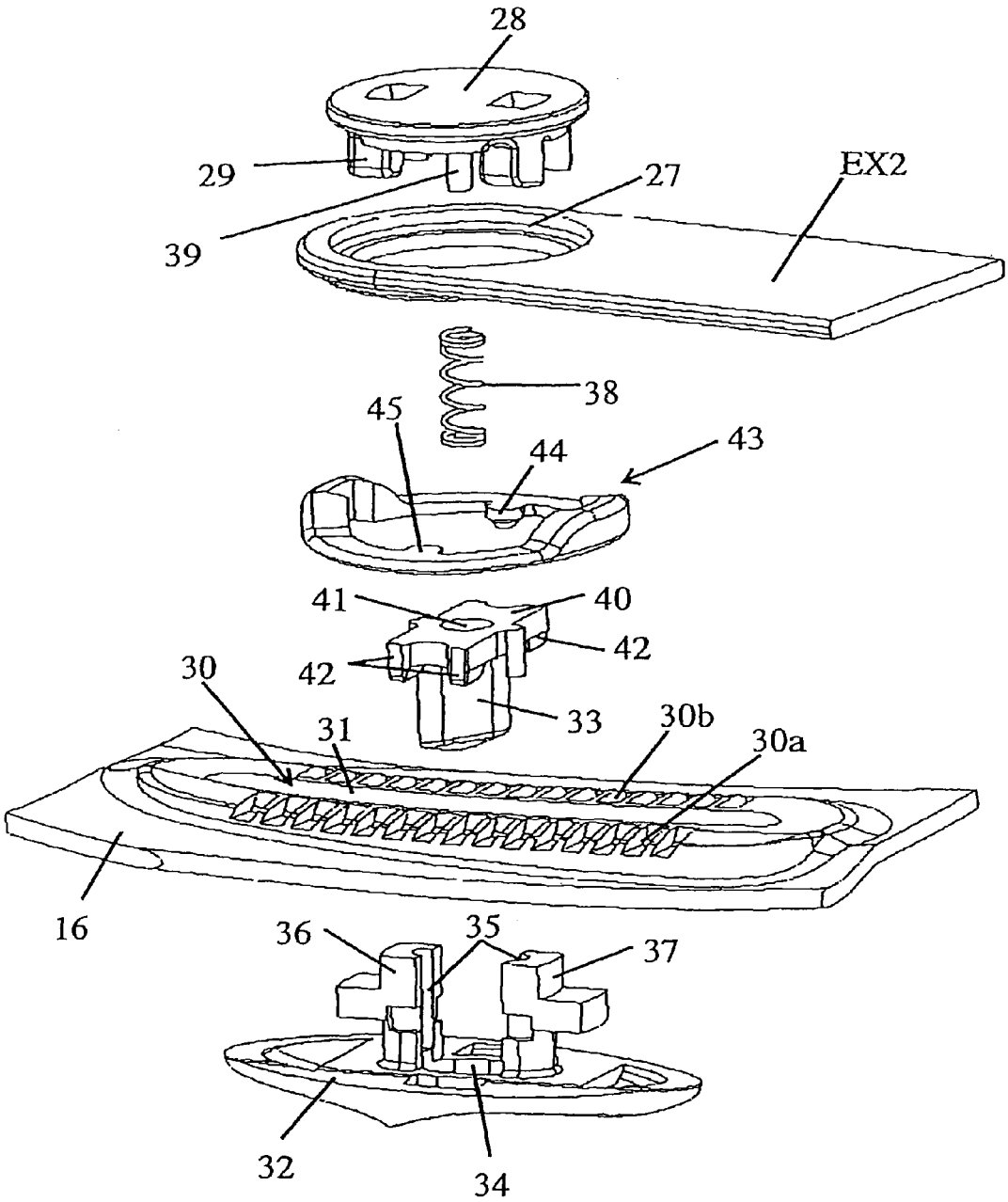
FIG. 2 is an exploded perspective view of the neckband adjustment device according to FIG. 1.
Figure 3:
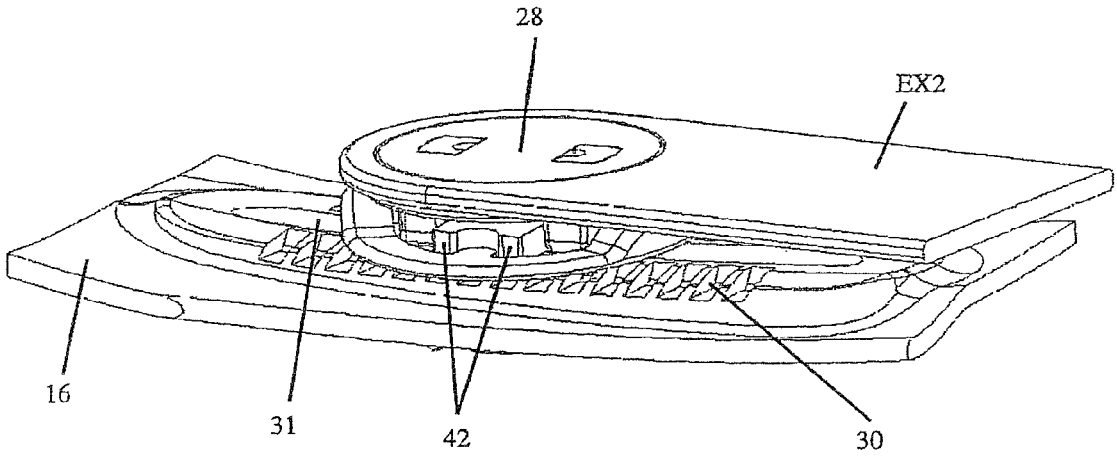
FIG. 3 shows the neckband adjustment device of FIG. 2 in the assembled position.
Figure 4:
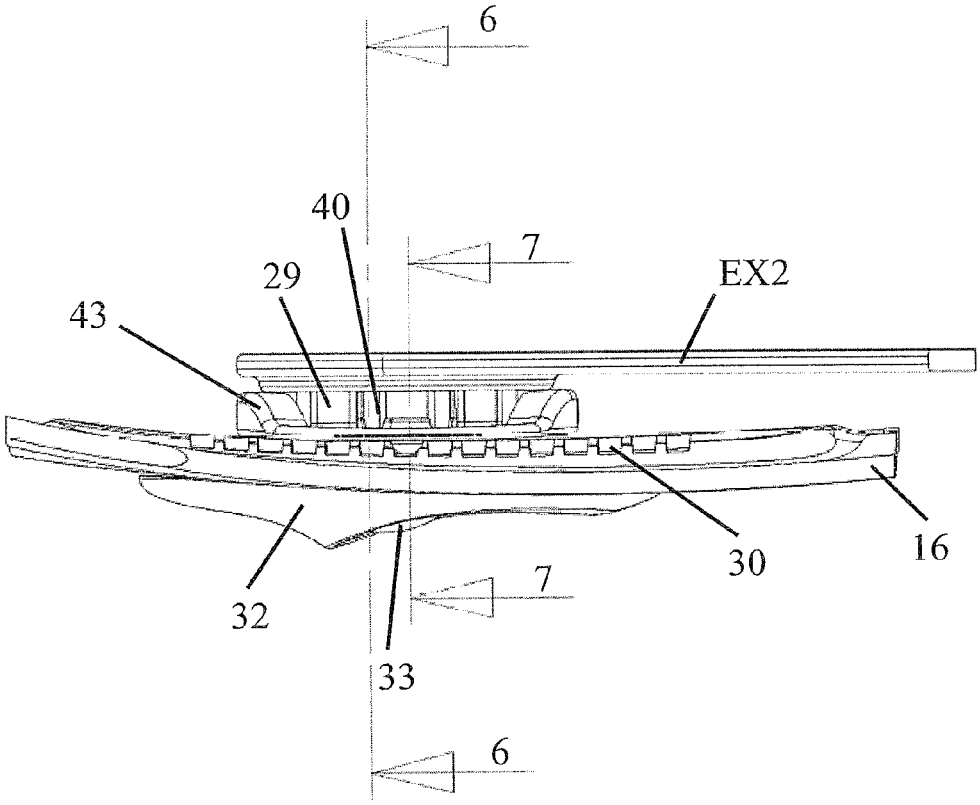
FIGS. 4 and 5 are cross-sectional views of the adjustment device of FIG. 3, respectively in the active position and in the inactive position of the unlocking button.
Figure 5:
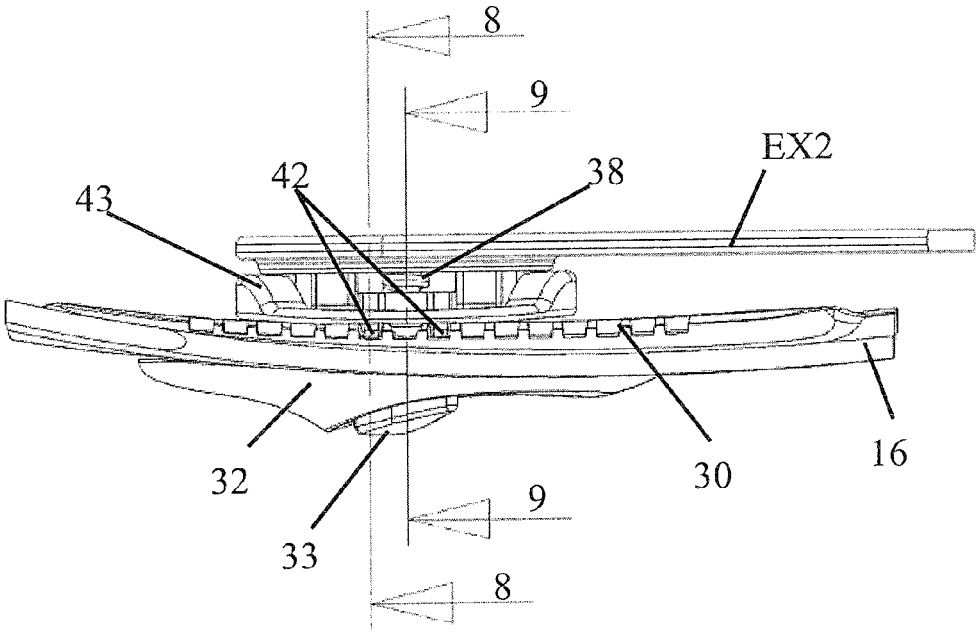
Figure 6:
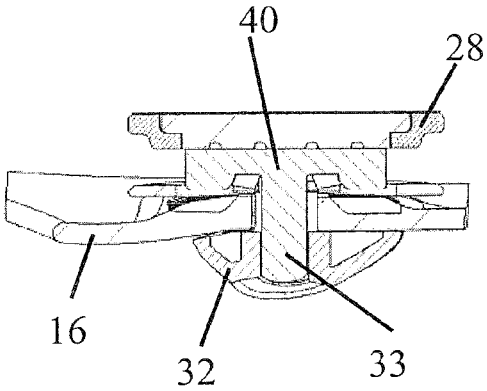
FIGS. 6 and 7 are cross-sectional views along the cross-sectional lines 6-6 and 7-7 of FIG. 4 when the unlocking button is in the active position enabling adjustment of the neckband in translation.
Figure 7:
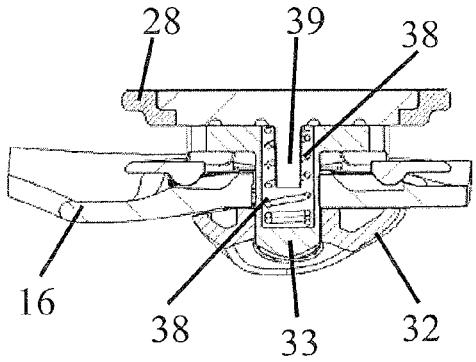
Figure 8:
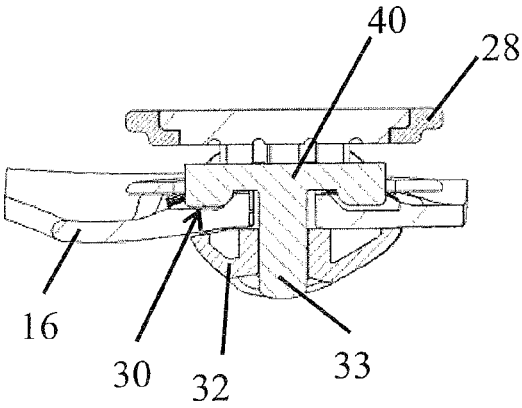
FIGS. 8 and 9 are cross-sectional views along the cross-sectional lines 8-8 and 9-9 of FIG. 5 when the unlocking button is in the inactive position corresponding to a predefined adjustment of the neckband.
Figure 9:
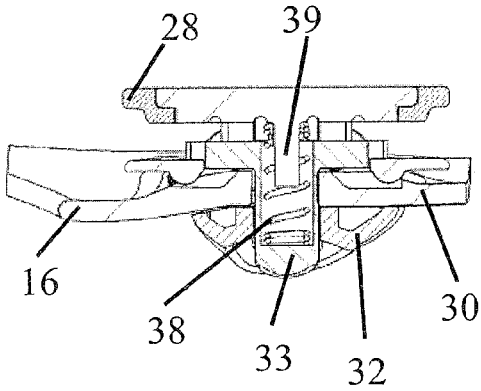
Figure 10:
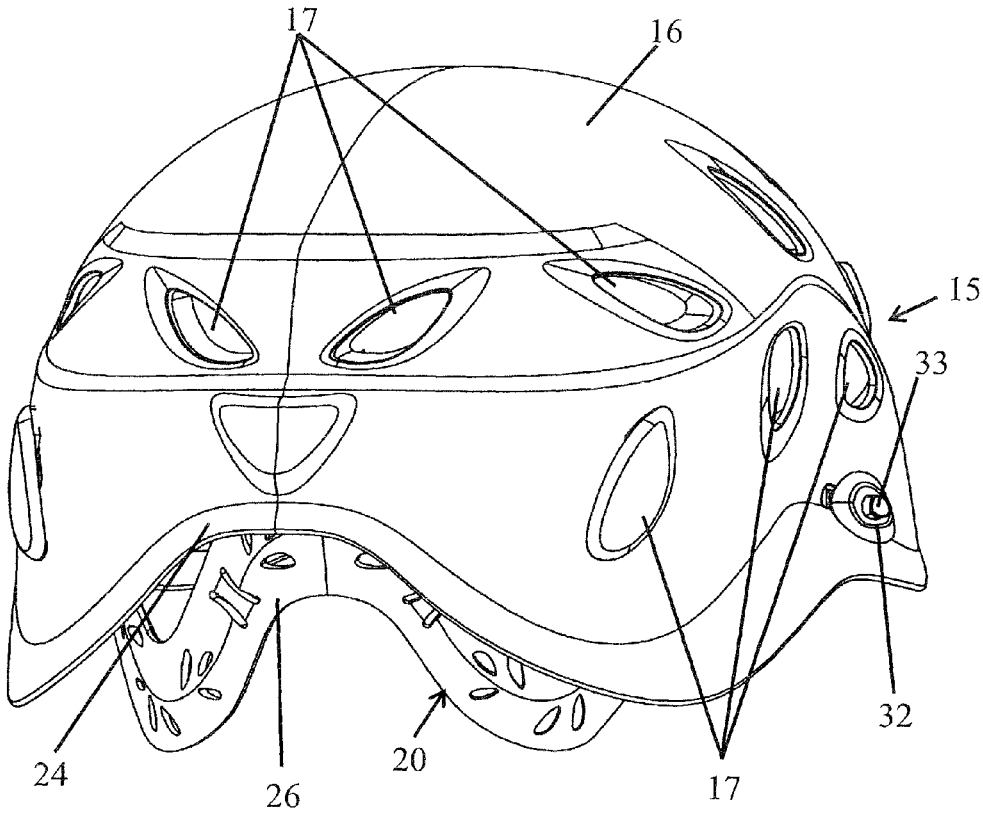
FIG. 10 is a perspective view from the rear of the helmet according to the invention.

In FIGS. 1 and 10, a helmet 15 comprises an external protective crown 16 made from injected polycarbonate or any other plastic material, in particular a thermoformed material or expanded polystyrene.

Crown 16 is equipped with a plurality of ventilation holes 17, a foam-padded shell 18 housed inside crown 16 with a headband 19, and a neckband 20. The neck strap is of well-known type and has not been represented in the drawings. Such a helmet is in particular well suited for rock-climbing, mountaineering, and also for working at heights.

Headband 19 extends along the front rim of crown 16, being joined by two joining arms 21, 22 to attachment means 23 securedly attached to the inside wall of crown 16. The rear peripheral rim of crown 16 is located opposite the front rim and has a curved reverse U-shaped outline 24. In the example of FIG. 1, headband 19 is not adjustable.

Neckband 20 is adjustable by adjustment means 25 accessible from the outside on the opposite lateral sides of crown 16.

In FIGS. 2 to 9 and 11, neckband 20 is formed by an Omega-shaped strip of flexible or semi-rigid plastic having two opposite ends EX1, EX2 and an intermediate part 26, which is offset from the outline 24 of crown 16 by a rear space. Each end EX1, EX2 of neckband 20 comprises a circular hole 27 in which there is engaged a securing prong 28 equipped with a plurality of pins 29 directed in the direction of a rack 30 arranged in the inside wall of crown 16.

Rack 30 comprises two series of parallel notches 30*a*, 30*b* separated from one another by a longitudinal slit 31 inside which a slide 32 moves after an unlocking button 33 has been actuated. Rack 30 is molded directly with crown 16, and unlocking button 33 passes through an opening 34 of slide 32 being guided in slides 35 arranged in the guide legs 36, 37 of slide 32.

A return spring 38 of the compression type is arranged between a centring pin 39 of securing prong 28 and a hole 41 arranged in a coupling part 40 securedly attached to unlocking button 33.

Coupling part 40 bears studs 42 cooperating with rack 30 by the action of return spring 38 biasing to the released position of unlocking button 33.

An auxiliary washer 43 (FIG. 2) is further fitted between rack 30 and corresponding end EX1, EX2 of neckband 20. Washer 43 comprises a pair of diametrically opposite semi-circular protuberances 44, 45 along the internal periphery so as to engage, for a predetermined adjustment, between two successive notches of each series of notches 30*a*, 30*b* of rack 30. Any change of adjustment emits an audible click of protuberances 44, 45 following movement of slide 32 in translation.

Figure 11:
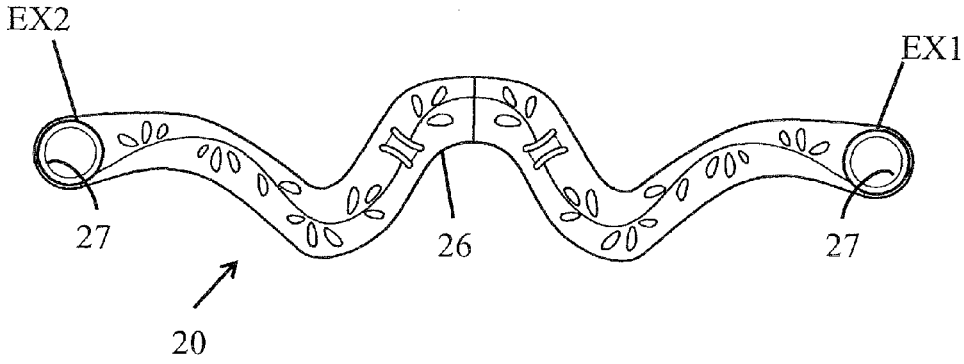
FIG. 11 represents a developed view of the neckband of FIGS. 1 and 10.

In FIG. 11, a developed view of neckband 20 of FIG. 10 shows the Omega shape with the middle intermediate part 26 providing a passage under outline 24 of crown 16, which is particularly practical for users having their hair in a pony-tail.

Figure 12:
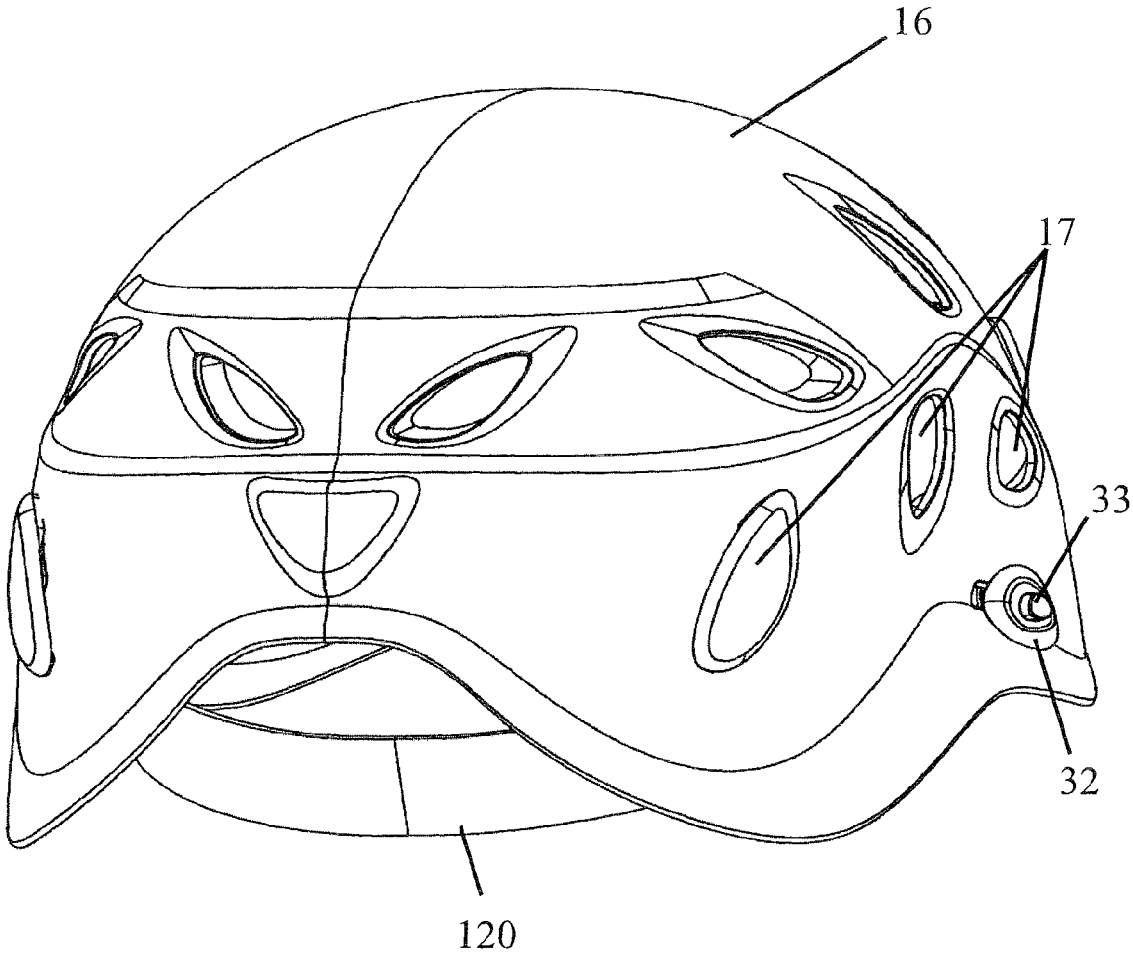
FIG. 12 is an identical view to FIG. 10 with an alternative embodiment of the neckband.

FIG. 12 shows a neckband 120 with a straight intermediate part and without a recess in the form of an arc. It is naturally suitable for persons not having pony-tails. Such a neckband 120 is also adjustable in translation by the adjustment means 25 of FIGS. 2-9.

Adjustment of neckband 20 according to the invention is performed in the following manner:

The user presses at the same time with both hands on the two unlocking buttons 33 against the force of return springs 38. Studs 42 of coupling part 40 leave rack 30, which releases ends EX1, EX2 of neckband 20. Slides 32 then simply have to be moved in translation in slits 31 until neckband 20 makes contact against the user's neck. Releasing unlocking buttons 33 automatically makes studs 42 move into the corresponding rack 30, thereby blocking the adjustment in the selected position.

Instead of having two adjustable ends EX1, EX2, it is also possible to have one fixed end and the other end adjustable.

It is clear that rack 30 can be replaced by any other position indexing means controlled from the external slide.

Adjustment is quick and is performed from the outside on the lateral sides of crown 16. No operation is necessary at the rear of helmet 15, whatever the type of neckband according to FIGS. 10 and 12. The length of the neckband remains constant during adjustment, whereas the positioning of its attachment point is made to vary by means of rack 30 located on the inside wall of crown 16.

The invention claimed is:

1. A protective helmet, comprising:

a crown made from plastic material;

a semi-rigid neckband having two opposite adjustable ends; and adjustment means having a pair of sliding mechanical links joined to said ends of the neckband, each of the sliding mechanical links comprising position indexing means controlled from a slide which is able to be moved from outside in a slit of the crown, the sliding mechanical links being positioned symmetrically on opposite lateral sides of the crown, wherein a length of the neckband remains constant during adjustment, the indexing means being molded directly along with the crown, said position indexing means are securely attached to an inside wall on each lateral side of the crown, and are formed by a rack having two series of notches separated by said slit, and an unlocking button of said slide has a coupling part bearing pins cooperating by clipping with the rack by action of a return spring that is a compression type spring that is arranged between a centering pin securely attached to a securing prong associated with each end of said neckband, and a hole arranged in the coupling part.

2. The protective helmet according to claim 1, wherein the slide supports two guide legs guiding the unlocking button when the unlocking button moves between active and inactive positions.

3. The protective helmet according to claim 1, wherein the slit for movement of the slide is straight.

4. The protective helmet according to claim 1, wherein the slit for movement of the slide is curved.

5. The protective helmet according to claim 1, wherein the neckband has an Omega-shaped outline having a curved central part for free passage of hair worn in a pony-tail to pass through freely.

6. The protective helmet according to claim 1, wherein the neckband comprises a straight central part.

* * * * *